US008579120B2

(12) United States Patent
Classen

(10) Patent No.: US 8,579,120 B2
(45) Date of Patent: Nov. 12, 2013

(54) CROCKERY BASKET FOR A DISHWASHER

(75) Inventor: Egbert Classen, Wertingen (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 1052 days.

(21) Appl. No.: 11/793,108

(22) PCT Filed: Oct. 25, 2005

(86) PCT No.: PCT/EP2005/055497

§ 371 (c)(1),
(2), (4) Date: Jun. 15, 2007

(87) PCT Pub. No.: WO2006/063900

PCT Pub. Date: Jun. 22, 2006

(65) Prior Publication Data

US 2008/0093314 A1 Apr. 24, 2008

(30) Foreign Application Priority Data

Dec. 17, 2004 (DE) ..... 10 2004 060 951

(51) Int. Cl.
*A47L 15/50* (2006.01)

(52) U.S. Cl.
USPC ..... 211/41.8; 211/132.1

(58) Field of Classification Search
USPC ..... 211/41.3–41.6, 41.8, 41.9, 126.6, 211/126.9, 130.1, 132.1, 133.2, 133.5, 211/181.1; 134/58 D, 135, 201, 85, 137, 134/108, 199, 200, 144
See application file for complete search history.

(56) References Cited

U.S. PATENT DOCUMENTS

| | | | | |
|---|---|---|---|---|
| 2,516,088 | A * | 7/1950 | Einhorn | 211/41.5 |
| 2,648,588 | A | 8/1953 | Ruspino | |
| 2,708,037 | A * | 5/1955 | Planeta | 211/74 |
| 4,046,261 | A * | 9/1977 | Yake | 211/41.8 |
| 5,205,419 | A * | 4/1993 | Purtilo | 211/41.8 |
| 5,344,029 | A * | 9/1994 | Oghia et al. | 211/41.8 |
| 5,406,895 | A * | 4/1995 | Suess | 108/149 |
| 5,497,890 | A * | 3/1996 | Clark | 211/41.8 |
| 6,546,942 | B2 * | 4/2003 | Smith et al. | 134/201 |
| 6,666,220 | B2 * | 12/2003 | Spanyer et al. | 134/58 D |

(Continued)

FOREIGN PATENT DOCUMENTS

| | | |
|---|---|---|
| DE | 69 20 819 U | 2/1970 |
| DE | 31 30 627 | 2/1983 |

(Continued)

OTHER PUBLICATIONS

International Search Report PCT/EP2005/055497.

*Primary Examiner* — Jennifer E Novosad
(74) *Attorney, Agent, or Firm* — James E. Howard; Andre Pallapies

(57) ABSTRACT

A crockery basket for a dishwasher includes a base frame having a base surface provided with an edge that is raised on at least one side. The crockery basket reduces the risk of injury caused by pointed elements and/or cutlery which project in an upward manner, in particular if the pointed end thereof if arranged towards the top, e.g. forks, steak knives, etc. As a result, the raised edge exceeds at least the height of the pointed elements of the cutlery basket which project in an upward manner and, optionally, the height of the cutlery which are pointed towards the top at least in a cutlery basket.

22 Claims, 5 Drawing Sheets

(56) References Cited

U.S. PATENT DOCUMENTS

| | | | | |
|---|---|---|---|---|
| 7,228,975 | B2 * | 6/2007 | Yang et al. | 211/41.4 |
| 2003/0075206 | A1 | 4/2003 | Spanyer et al. | |
| 2004/0020876 | A1 | 2/2004 | Rosenbauer et al. | |
| 2005/0241686 | A1 * | 11/2005 | Woo | 134/135 |
| 2007/0039904 | A1 * | 2/2007 | Purushothaman | 211/41.8 |
| 2008/0083678 | A1 * | 4/2008 | Graute | 211/41.8 |

FOREIGN PATENT DOCUMENTS

| | | |
|---|---|---|
| DE | 35 37 185 | 4/1987 |
| DE | 88 11 474 U | 11/1988 |
| EP | 1 306 046 | 5/2003 |
| FR | 1.356.844 | 3/1964 |
| JP | 11-346984 | 12/1999 |

* cited by examiner

CROCKERY BASKET FOR A DISHWASHER

The invention relates to a crockery basket for a dishwasher comprising a base frame consisting of a base surface provided with an upwardly standing edge on at least one side.

It is generally known to use crockery baskets of the type specified initially to hold crockery items—such as plates, cups, glasses, cutlery etc. in dishwashers, where the crockery baskets have upwardly standing pointed elements or loops, optionally inclined in one plane. Such a crockery basket is known, for example, from German Unexamined Laid-Open Patent Application DE-31 30 627 A1 or from German Utility Model DE-88 11 474 U1. These pointed elements or loops are used for holding plates in the crockery basket and in all known crockery baskets of the type specified initially, project upwards from the crockery basket.

In crockery baskets of the type specified initially, additional removable inserts, so-called cutlery baskets are usually provided to hold cutlery, in which the cutlery items to be cleaned, e.g. knives, forks, spoons etc. are arranged substantially vertically upwards in the position of use. Such cutlery baskets are known, for example, from German Unexamined Laid-Open Patent Application DE-100 56 487 A1. In all the known crockery baskets of the type specified initially, the cutlery items arranged in these cutlery baskets project upwards from the crockery basket.

Dishwashers known on the market, in particular domestic dishwashers, have at least one crockery basket for arranging the items to be cleaned, where the at least one cutlery basket is usually arranged in the crockery basket which, when the door of the dishwasher is opened, rests thereon when withdrawn, in the lowermost crockery basket. The door of such dishwashers is usually pivotable about a horizontal axis. Such doors are known, for example, from German patent DE-35 37 185-C1.

In practice, it has been shown that when dishwashers are placed on the floor, the pointed elements described previously as well as the cutlery items, particularly when these are arranged so that their tips project upwards from the cutlery basket, present a major source of danger. When a door is opened out and then runs in a plane parallel to the floor at a short distance from the floor, inattentive persons, in particular children, could stumble over the open door and fall onto the crockery basket, sustaining considerable injuries from pointed elements and/or items of cutlery projecting upwards from the crockery basket, especially if these are arranged with their tips pointing upwards, e.g. forks, steak knives etc.

It is thus the object of the invention to at least significantly reduce the risk of injury described above in a simple fashion.

This object is achieved according to the invention by the upwardly standing edge at least exceeding the height of the upwardly standing pointed elements of the crockery basket and optionally the height of the cutlery items arranged upwardly in at least one cutlery basket.

Since the edge of the crockery basket is higher than the hazardous components of the crockery basket or than the hazardous inserted objects, in the case of a child, falling onto the crockery basket can be completely avoided depending on the height. In the case of physically larger persons, the risk of injury is significantly reduced since a person falling onto the crockery basket is kept at a distance from the hazardous components of the crockery basket or from the hazardous inserted objects by the raised edge. The invention significantly reduces or even completely avoids the risk of injury from upwardly projecting pointed elements and/or items of cutlery in a simple manner.

To complete the protection, according to a preferred feature of the invention, the upwardly standing edge which at least exceeds the height of the upwardly standing pointed elements of the crockery basket and optionally the height of the cutlery items arranged so that they point upwards in at least one cutlery basket, surrounds the base surface at least at the sides which project from the dishwasher when the crockery basket is withdrawn.

According to an advantageous embodiment of the invention, in dishwashers with at least two crockery baskets arranged one above the other, the lowermost crockery basket in the position of use has the upwardly standing edge which exceeds at least the height of the upwardly standing pointed elements of the crockery basket and optionally the height of the cutlery items arranged so that they point upwards in at least one cutlery basket, its height being limited by the next crockery basket arranged above the lowermost crockery basket and its spray device in the position of use or alternatively in dishwashers having only one crockery basket, this has the upwardly standing edge which exceeds at least the height of the upwardly standing pointed elements of the crockery basket and optionally the height of the cutlery items arranged so that they point upwards in at least one cutlery basket, its height being limited by the opening height of the treatment chamber of the dishwasher. This measure ensures that at the location of the hazard, the object of avoiding injuries according to the invention is achieved.

According to another advantageous embodiment of the invention, the upwardly standing edge extends over the lower edge of next crockery basket arranged above the lowermost crockery basket. Thus, there is no longer any intermediate space between the crockery baskets arranged one above the other so that the object of avoiding injuries according to the invention is further improved.

According to a preferred embodiment of the invention, the upwardly standing edge can be at least partially removed. This measure ensures that the object of avoiding injuries according to the invention is also achieved with crockery baskets located at the user since these can be retrofitted. Thus, it is additionally possible, for example, when the children are grown up, to further operate the retrofitted crockery basket and also that originally fitted with the edge in the usual form by removing the additional edge, in which case in particular it is easier to fill the crockery basket with items to be washed.

The dishwasher according to the invention is preferably manufactured simply if the upwardly standing edge consists of individual edge portions, where as prescribed, the number of individual edge portions at least corresponds to the number of sides which project from the dishwasher when the crockery basket is withdrawn.

In a particularly advantageous manner, the individual edge portions of the removable edge portion are hinged about vertical axes in the position of use so that the removable edge portion is foldable, allowing space-saving storage.

According to another advantageous alternative, the upwardly standing edge can be at least partly separated about an approximately horizontal dividing line in the position of use. The partially removable edge portions make it easier to fill the crockery basket.

According to another advantageous embodiment of the invention, the upwardly standing edge can be at least partly folded about an approximately horizontal axis in the position of use and thus forms a folding edge. The arrangement of folding edges increases the avoidance of injury forming the object of the invention still further since the hazardous points are additionally covered by a cover.

The folding edge can advantageously be fixed, thus making it easier to fill the crockery basket.

In a particularly advantageous manner, the folding edge is hinged so that after the position which can be fixed, has been released, it falls towards the inner side of the crockery basket so that the avoidance of injury forming the object of the invention is improved still further since the hazardous points are additionally and independently covered by a cover.

In a particularly advantageous manner, the divisible edge and/or the folding edge extends at least at one of the sides which project from the dishwasher when the crockery basket is withdrawn. The arrangement of the cover on one of the sides increases the avoidance of injury forming the object of the invention still further since the hazardous points are easily reached through the cover from the side portions.

The divisible edge and/or the folding edge preferably extends at the front side of the sides which project from the dishwasher when the crockery basket is withdrawn, so that it is easiest to handle as a result of the simple accessibility from the front.

The invention is explained hereinafter with reference to the exemplary embodiments shown in the drawings. In the figures:

FIG. 1 is a schematic diagram of a dishwasher in side view with the door open and the preferred embodiment of a crockery basket according to the invention, FIG. 2 is a front view of the dishwasher according to FIG. 1, FIG. 3 is the preferred embodiment of the crockery basket according to the invention, FIG. 4 is a schematic view of a dishwasher in side view with the door open and another advantageous embodiment of a crockery basket according to the invention, FIG. 5 is a front view of the dishwasher according to FIG. 4, FIG. 6 is a schematic view of a dishwasher in side view with the door open and yet another advantageous embodiment of a crockery basket according to the invention, FIG. 7 shows part of the further advantageous embodiment of the crockery basket according to the invention according to FIG. 6 in an enlarged perspective view.

Figure 1:
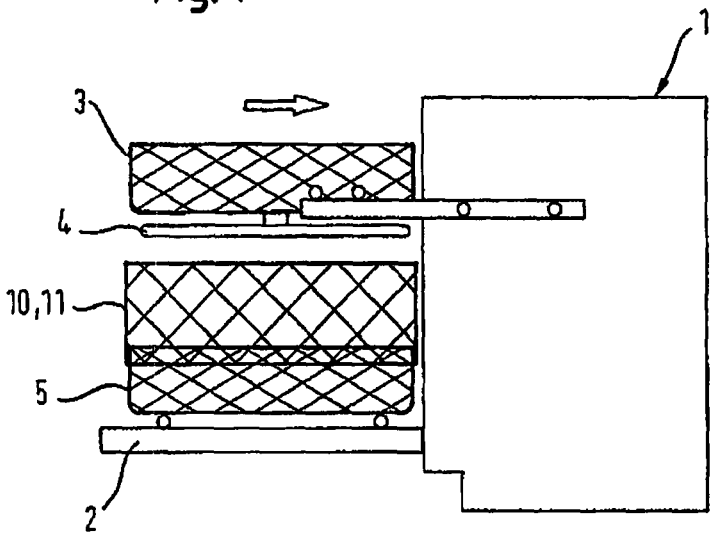

Shown schematically in FIGS. 1, 2, 4, 5, 6, 8, and 9 is a dishwasher, in the exemplary embodiments shown a domestic dishwasher 1 not described in detail, whose treatment chamber not described in detail—the washing container—can be closed by means of a door 2 which is pivotable about a horizontal axis in the exemplary embodiments shown. Such dishwashers 1 usually having two crockery baskets 3, 5 which are show as withdrawn for loading or unloading in FIGS. 1, 2, 4, 5 and 6. The crockery baskets usually each have spray devices, only one spray arm 4 allocated to the upper crockery basket 3 being shown in FIGS. 1, 2, 4, 5, 6, 8, and 9.

Figure 3:
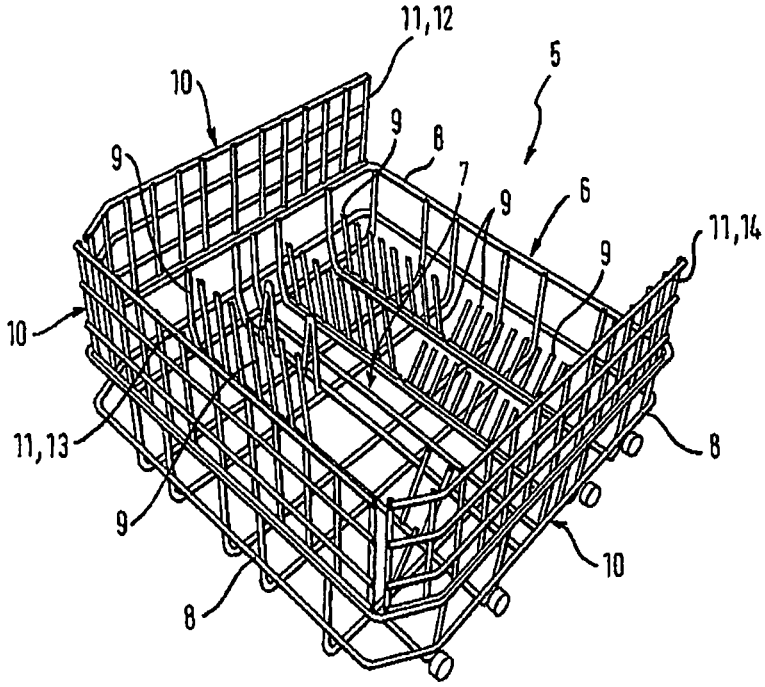

FIG. 3 shows a crockery basket 5 according to the invention which has been removed from the washing container of the dishwasher 1. This lower crockery basket 5 consists of a base frame 6 consisting of a base surface 7 with an upwardly standing edge 8 on at least one side, in the exemplary embodiment shown on all four sides of the crockery basket 5, having a usual height which can still be identified at the back of the crockery basket 5. The crockery basket 5 has upwardly standing pointed elements 9, optionally inclined in a plane, which are used to hold, e.g. plates in the lower crockery basket 5 and in all known dishwashers and also in the lower crockery basket 5 in the exemplary embodiment shown, project upwards from the crockery basket 5. Removable inserts, so-called cutlery baskets, not shown, are usually provided in crockery baskets and in the lower crockery basket 5 in the exemplary embodiment shown to hold cutlery, in which the items of cutlery to be cleaned, e.g. knives, forks, spoons etc. are arranged so that they point upwards in the position of use. The cutlery items arranged in such cutlery baskets project upwards from the lower crockery basket 5 in all known crockery baskets and also in the lower crockery basket 5 in the exemplary embodiment shown.

In order to reduce any risk of injury with such a crockery basket 5 as a result of upwardly projecting pointed elements 9 and/or cutlery items, in particular when these are arranged with their tip pointing upwards, e.g. forks, steak knives etc., according to the invention the upwardly standing edge 10 at least exceeds the height of the upwardly standing pointed elements 9 of the crockery basket 5 and optionally the height of the cutlery items arranged upwardly in at least one cutlery basket.

Since the edge 10 of the crockery basket 5 is higher than the hazardous components of the crockery basket 5 or than the hazardous inserted objects, in the case of a child, falling onto the crockery basket 5 can be completely avoided depending on the height. In the case of physically larger persons, the risk of injury is significantly reduced since a person falling onto the crockery basket 5 is kept at a distance from the hazardous components of the crockery basket 5 or from the hazardous inserted objects by the raised edge 5. The invention significantly reduces or even completely avoids the risk of injury from upwardly projecting pointed elements 9 and/or items of cutlery in a simple manner.

In the exemplary embodiments shown, the upwardly standing edge 10 is at least partly removable and in the exemplary embodiment shown the edge portion 11, 11', 11" of the edge 10 can be removed from the edge 8 which is fixedly connected to the base surface 7. It is thereby possible, for example when the children have grown up, to further operate the crockery basket 5 in the usual form, whereby in particular, it is easier to fill with items to be washed.

Figure 2:
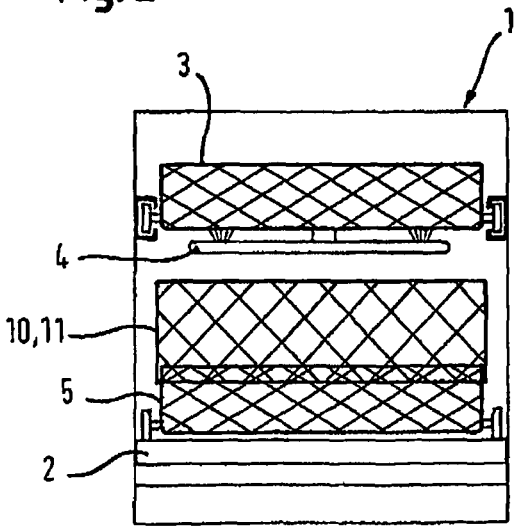

In the preferred exemplary embodiment shown in FIGS. 1, 2 and 3, the removable edge portion 11 consists of individual edge portions 12, 13, 14 which are connected by means of suitable hinge portions not explained in detail so that the removable edge portion 11 is foldable, thus allowing space-saving storage. Alternatively, the removable edge portion can also consist of individually removable individual edge portions.

In the exemplary embodiment shown, the raised edge 10 surrounds the base surface 7 on the three sides which project from the dishwasher I when the crockery basket 5 is withdrawn, i.e. in the crockery basket 1 shown in FIG. 3, the left, front and right side. Since the front and the left and right sides of the crockery basket 5 project from the dishwasher when the crockery basket 5 is withdrawn from the treatment chamber, the number of individual edge portions 12, 13, 14 thus at least corresponds to the number of sides which project from the dishwasher when the crockery basket 5 is withdrawn.

As has already been mentioned, in the exemplary embodiments shown the dishwasher 1 not described in detail has two crockery baskets 3, 5. In these dishwashers 1 the lowermost crockery basket 5 in the position of use is advantageously fitted with a raised upwardly standing edge 10. Its height is limited by the next crockery basket 3 arranged above the lowermost crockery basket 5 and its spray device 4 in the position of use.

Figure 8:
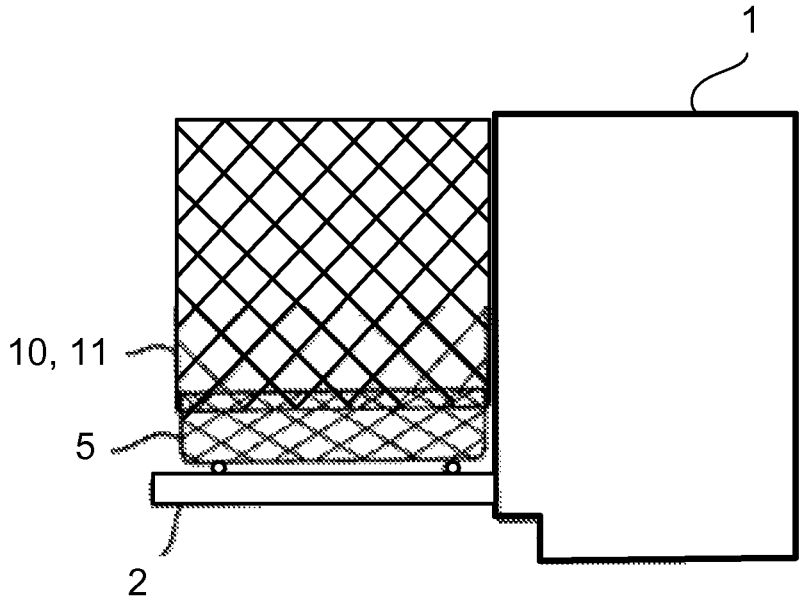
FIG. 8 shows schematic view of a dishwasher in side view with the door open according to an exemplary embodiment of the invention.
Figure 9:
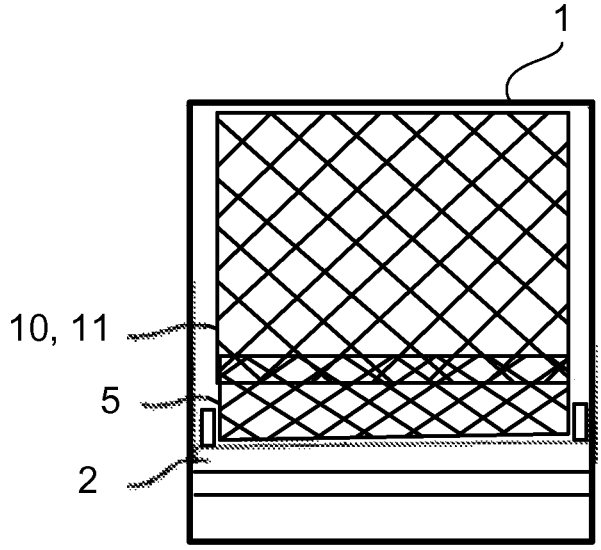
FIG. 9 shows schematic front view of a dishwasher with the door open according to FIG. 8.

Alternatively, as exemplarily illustrated in FIGS. 8 and 9, in dishwashers having only one crockery basket, this has the raised edge approximately perpendicular to the base surface, its height then being limited by the opening height of the treatment chamber of the dishwasher.

Figure 4:
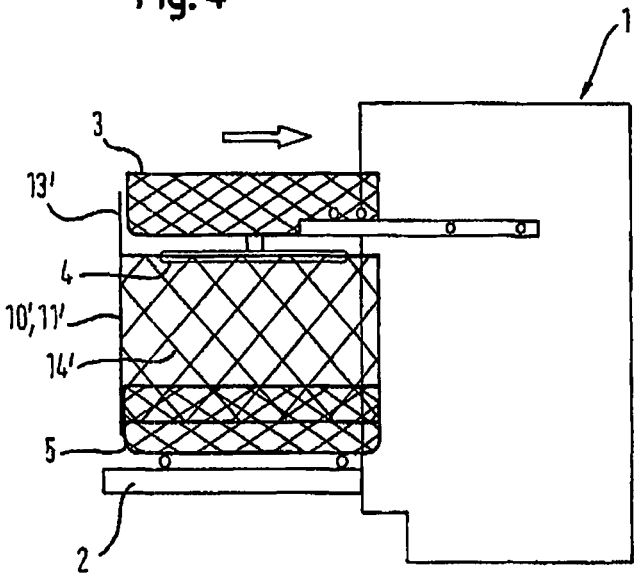
Figure 5:
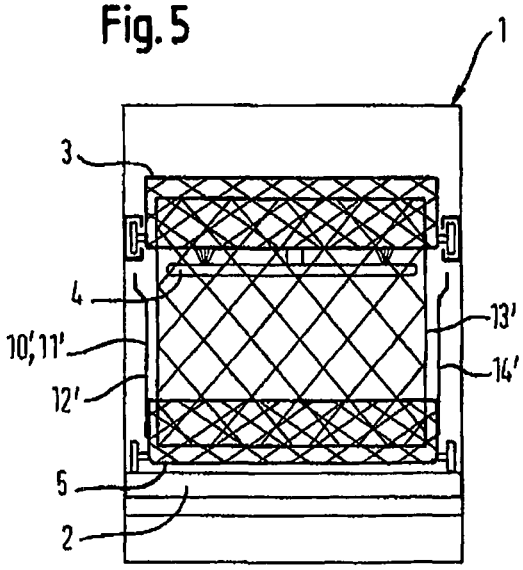

As another alternative, FIGS. 4 and 5 show another advantageous embodiment of the crockery basket according to the invention, in the exemplary embodiment shown of the lower crockery basket 5 in which the upwardly standing edge 10' extends over the lower edge of next crockery basket 3 arranged above the lowermost crockery basket 5. As can be seen clearly in FIGS. 4 and 5, the front side portion 13' is significantly higher than the left side portion 12' and also the right side portion 14' of the upwardly standing edge 10' whose height is limited by runners not described in detail.

Figure 6:
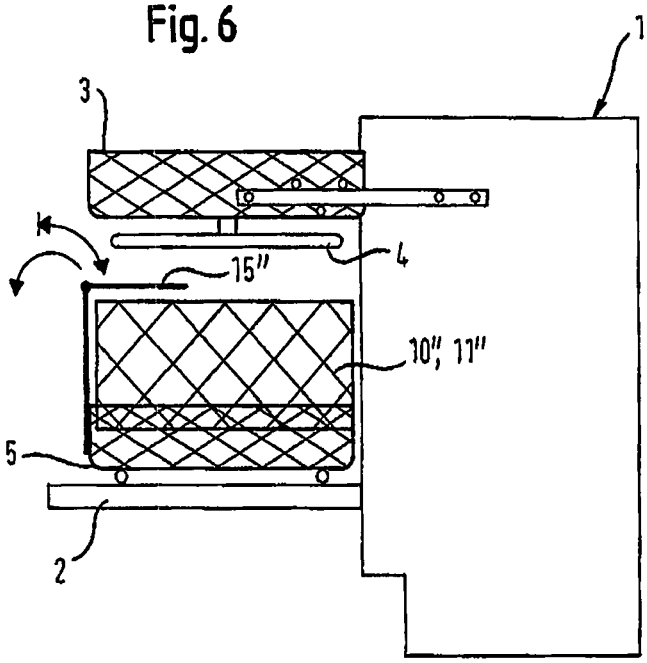
Figure 7:
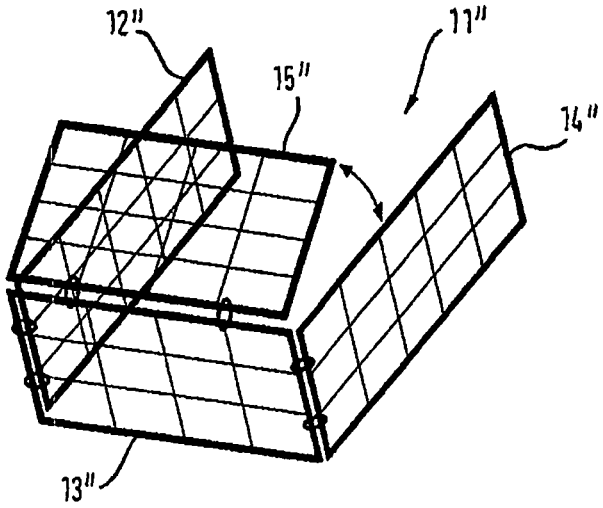

As another alternative, FIGS. 6 and 7 show another advantageous embodiment of the crockery basket according to the invention, in the exemplary embodiment of the lower crockery basket 5, in which the upwardly standing edge 10" can be at least partly folded about an approximately horizontal axis in the position of use and thus forms a folding edge 15", this folding edge 15" extending at least on one of the sides of the base surface 7, in the exemplary embodiment shown at the front side portion 13" of the edge portion 11", so that it is easiest to handle as a result of the easy accessibility from the front to which it is connected by means of suitable hinge portions not explained in detail. The arrangement of folding edges 15" increases the avoidance of injury forming the object of the invention still further since the hazardous points are additionally covered by a cover.

The arrows shown in FIG. 6 show two possible alternatives for movement of the folding edge 15", of which fixing of the folding edge 15" is provided in one possible movement and complete folding over of the folding edge 15" is provided in the second possible movement. Suitable hinges fitted with fixing eyes not described in detail are used for fixing the folding edge 15".

FIG. 7 shows the removable edge portion 11" according to the further advantageous embodiment of the crockery basket 5 according to the invention in an enlarged, perspective view wherein in this further advantageous embodiment, as in the preferred embodiment shown in FIG. 3, the removable edge portion 11" consists of individual edge portions 12", 13", 14" which are connected by means of suitable hinge portions not explained in detail so that the removable edge portion 11" is foldable, thus allowing space-saving storage. Alternatively, as in the preferred embodiment shown in FIG. 3, the removable portion can also consist of individually removable individual edge portions.

The arrow in FIG. 7 is intended to indicate that the folding edge 15" is hinged so that after being released, it is either moved into the perpendicular position described above in the position of use or into the completely folded-over position towards the inner side of the crockery basket 5, possibly supported by suitable means so that the avoidance of injury forming the object of the invention is improved still further since the hazardous points are additionally and independently covered by a cover.

As another alternative of the crockery basket according to the invention, the upwardly standing edge can be at least partly separated about an approximately horizontal separating line in the position of use. These partially removable edge portions can also facilitate the filling of the crockery basket. The divisible edge like the previously described folding edge 15" extends at least at one of the sides which project from the dishwasher when the crockery basket is withdrawn and preferably at the front side of the sides which project from the dishwasher when the crockery basket is withdrawn, so that it is easiest to handle from the front as a result of the easy accessibility. The raised edge of a crockery basket fitted with at least one partially removable edge portion can be removable in the same way as the edge portions described above and consist of individual sides which are possibly also hinged so that they can fold.

The invention significantly reduces or even completely avoids the risk if injury by upwardly projecting pointed elements and/or cutlery items in a simple manner.

The invention claimed is:

1. A crockery basket for a dishwasher, the crockery basket comprising:

a base frame having a base surface;

a plurality of upwardly standing pointed elements each extending upwardly from the base surface;

a plurality of upwardly standing sides each extending upwardly from a perimeter edge of the base surface and along a length of the perimeter edge;

a cutlery basket configured to receive a predetermined type of cutlery items having a predetermined size and arranged such that the cutlery items point upwards from the cutlery basket and extend above the cutlery basket by a predetermined maximum height; and an upwardly standing edge extending upwardly from at least one side of the plurality of upwardly standing sides of the base surface and along a length of the at least one side, the upwardly standing edge having a height that exceeds a height of the upwardly standing pointed elements of the crockery basket and a height corresponding to the predetermined maximum height above the cutlery basket of the cutlery items for which the cutlery basket is configured to receive, wherein the upwardly standing edge surrounds the base surface at least at sides which project from the dishwasher when the crockery basket is withdrawn.

2. The crockery basket according to claim 1, wherein the cutlery basket is operable to be disposed in dishwashers with only one crockery basket and the only one crockery basket has the upwardly standing edge which exceeds the height of the upwardly standing pointed elements of the crockery basket and the height of the cutlery items arranged such that the cutlery items point upwards in at least one cutlery basket, a height of the upwardly standing edge being limited by an opening height of a treatment chamber of the dishwasher.

3. The crockery basket according to claim 1, wherein the upwardly standing edge extends over a lower edge of a next crockery basket arranged above a lowermost crockery basket.

4. The crockery basket according to claim 1, wherein the upwardly standing edge is at least partially removable.

5. The crockery basket according to claim 4, wherein a removable edge portion consists of individual edge portions.

6. The crockery basket according to claim 5, wherein a number of the individual edge portions at least corresponds to a number of sides which project from the dishwasher when the crockery basket is withdrawn.

7. The crockery basket according to claim 5, wherein the individual edge portions of the removable edge portion are hinged about vertical axes in a position of use such that the removable edge portion is foldable.

8. The crockery basket according to claim 1, wherein the upwardly standing edge is at least partly separable about an approximately horizontal dividing line in a position of use.

9. The crockery basket according to claim 8, wherein one of a divisible edge and a folding edge extends at least at one side which projects from the dishwasher when the crockery basket is withdrawn.

10. The crockery basket according to claim 1, wherein the upwardly standing edge is at least partly foldable about an approximately horizontal axis in a position of use and forms a folding edge.

11. The crockery basket according to claim 10, wherein the folding edge is fixable.

12. The crockery basket according to claim 10, wherein the folding edge is hinged such that after a fixable position has been released, the folding edge falls towards an inner side of the crockery basket.

13. The crockery basket according to claim 12, wherein one of a divisible edge and a folding edge extends at a front side of sides which project from the dishwasher when the crockery basket is withdrawn.

14. A dishwasher including the crockery basket according to claim 1.

15. The crockery basket according to claim 1, wherein at least a portion of the upwardly standing edge includes a folding edge;

wherein the folding edge extends at least along one side portion of the base surface which projects from the dishwasher when the crockery basket is withdrawn.

16. The crockery basket according to claim 15, wherein a height of the folding edge in a folded position exceeds the height of the upwardly standing pointed elements of the crockery basket and the height of cutlery items arranged in the cutlery basket.

17. The crockery basket according to claim 1, wherein at least a portion of the upwardly standing edge includes a folding edge; and wherein the folding edge extends at least along a front portion of the base surface which projects from the dishwasher when the crockery basket is withdrawn.

18. The crockery basket according to claim 17, wherein a height of the folding edge in a folded position exceeds the height of the upwardly standing pointed elements of the crockery basket and the height of cutlery items arranged in the cutlery basket.

19. A crockery basket for a dishwasher, the crockery basket comprising:

a base frame having a base surface;

a plurality of upwardly standing pointed elements each extending upwardly from the base surface;

a plurality of upwardly standing sides each extending upwardly from a perimeter edge of the base surface and along a length of the perimeter edge;

a cutlery basket configured to receive a predetermined type of cutlery items having a predetermined size and arranged such that the cutlery items point upwards from the cutlery basket and extend above the cutlery basket by a predetermined maximum height; and an upwardly standing edge extending upwardly from at least one side of the plurality of upwardly standing sides of the base surface and along a length of the at least one side, the upwardly standing edge having a height that exceeds a height of the upwardly standing pointed elements of the crockery basket and a height corresponding to the predetermined maximum height above the cutlery basket of the cutlery items for which the cutlery basket is configured to receive, wherein the cutlery basket is operable to be disposed in dishwashers with at least two crockery baskets arranged one above the other, a lowermost crockery basket in the position of use has the upwardly standing edge which exceeds the height of the upwardly standing pointed elements of the crockery basket and the height of the cutlery items arranged such that the cutlery items point upwards in at least one cutlery basket, a height of the upwardly standing edge being limited by a next crockery basket arranged above the lowermost crockery basket and a spray device in a position of use.

20. A crockery basket for a dishwasher, the crockery basket comprising:

a base frame having a base surface;

a plurality of upwardly standing pointed elements each extending upwardly from the base surface;

a plurality of upwardly standing sides each extending upwardly from a perimeter edge of the base surface and along a length of the perimeter edge;

a cutlery basket configured to receive a predetermined type of cutlery items having a predetermined size and arranged such that the cutlery items point upwards from the cutlery basket and extend above the cutlery basket by a predetermined maximum height; and an upwardly standing edge extending upwardly from at least one side of the plurality of upwardly standing sides of the base surface and along a length of the at least one side, the upwardly standing edge having a height that exceeds a height of the upwardly standing pointed elements of the crockery basket and a height corresponding to the predetermined maximum height above the cutlery basket of the cutlery items for which the cutlery basket is configured to receive, wherein the upwardly standing edge is formed on a front portion and side portions of the base surface which project from the dishwasher when the crockery basket is withdrawn, and wherein a height of a front edge of the upwardly standing edge is greater than a height of side edges of the upwardly standing edge.

21. A dishwasher comprising:

a crockery basket including:

a base frame having a base surface;

a plurality of upwardly standing pointed elements each extending upwardly from the base surface;

a plurality of upwardly standing sides each extending upwardly from a perimeter edge of the base surface and along a length of the perimeter edge;

a cutlery basket configured to receive a predetermined type of cutlery items having a predetermined size and arranged such that the cutlery items point upwards from the cutlery basket and extend above the cutlery basket by a predetermined maximum height; and an upwardly standing edge extending upwardly from at least one side of the plurality of upwardly standing sides of the base surface and along a length of the at least one side, the upwardly standing edge having a height that exceeds a height of the upwardly standing pointed elements of the crockery basket and a height corresponding to the predetermined maximum height above the cutlery basket of the cutlery items for which the cutlery basket is configured to receive, wherein the upwardly standing edge surrounds the base surface at least at sides which project from the dishwasher when the crockery basket is withdrawn;

a treatment chamber having an opening;

a door for accessing an interior of the treatment chamber though the opening;

the crockery basket being movable between a position inside the treatment chamber and a position in which a portion of the crockery basket is withdrawn from the treatment chamber through the opening; and a second crockery basket arranged in the treatment chamber and above the crockery basket, the second crockery basket having a spray device coupled to an underside of the second crockery basket, wherein the height of the upwardly standing edge of the crockery basket is limited by the underside of the second crockery basket and the spray device of the second crockery basket in a position of use.

22. A dishwasher comprising:

a crockery basket including:

a base frame having a base surface;

a plurality of upwardly standing pointed elements each extending upwardly from the base surface;

a plurality of upwardly standing sides each extending upwardly from a perimeter edge of the base surface and along a length of the perimeter edge;

a cutlery basket configured to receive a predetermined type of cutlery items having a predetermined size and arranged such that the cutlery items point upwards from the cutlery basket and extend above the cutlery basket by a predetermined maximum height; and an upwardly standing edge extending upwardly from at least one side of the plurality of upwardly standing sides of the base surface and along a length of the at least one side, the upwardly standing edge having a height that exceeds a height of the upwardly standing pointed elements of the crockery basket and a height corresponding to the predetermined maximum height above the cutlery basket of the cutlery items for which the cutlery basket is configured to receive, wherein the upwardly standing edge surrounds the base surface at least at sides which project from the dishwasher when the crockery basket is withdrawn;

a treatment chamber having an opening, the opening having an opening height; and a door for accessing an interior of the treatment chamber though the opening;

the crockery basket being movable between a position inside the treatment chamber and a position in which a portion of the crockery basket is withdrawn from the treatment chamber through the opening;

wherein the height of the upwardly standing edge of the crockery basket is limited by the opening height of the opening such that the crockery basket is freely movable between the position inside the treatment chamber and the position in which the portion of the crockery basket is withdrawn from the treatment chamber through the opening.

* * * * *

UNITED STATES PATENT AND TRADEMARK OFFICE

CERTIFICATE OF CORRECTION

PATENT NO. : 8,579,120 B2
APPLICATION NO. : 11/793108
DATED : November 12, 2013
INVENTOR(S) : Egbert Classen It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 227 days.

Signed and Sealed this
Twenty-second Day of September, 2015

Michelle K. Lee

Michelle K. Lee
*Director of the United States Patent and Trademark Office*